US008069049B2

(12) United States Patent
Nilsson et al.

(10) Patent No.: US 8,069,049 B2
(45) Date of Patent: Nov. 29, 2011

(54) SPEECH CODING SYSTEM AND METHOD

(75) Inventors: Mattias Nilsson, Sundbyberg (SE); Jonas Lindblom, Solna (SE); Renat Vafin, Tallinn (EE); Soren Vang Andersen, Aalborg (DK)

(73) Assignee: Skype Limited, Dublin (IE)

( * ) Notice: Subject to any disclaimer, the term of this patent is extended or adjusted under 35 U.S.C. 154(b) by 918 days.

(21) Appl. No.: 12/006,058

(22) Filed: Dec. 28, 2007

(65) Prior Publication Data

US 2008/0221906 A1 Sep. 11, 2008

(30) Foreign Application Priority Data

Mar. 9, 2007 (GB) ..... 0704622.0

(51) Int. Cl.
*G10L 19/00* (2006.01)

(52) U.S. Cl. ..... 704/500; 704/E21.011

(58) Field of Classification Search ..... 704/500, 704/E21.011

See application file for complete search history.

(56) References Cited

U.S. PATENT DOCUMENTS

| | | | | |
|---|---|---|---|---|
| 5,615,298 | A * | 3/1997 | Chen | 704/228 |
| 6,029,126 | A * | 2/2000 | Malvar | 704/204 |
| 6,058,360 | A * | 5/2000 | Bergstrom | 704/219 |
| 6,098,036 | A * | 8/2000 | Zinser et al. | 704/219 |
| 6,240,380 | B1 * | 5/2001 | Malvar | 704/204 |
| 6,275,806 | B1 * | 8/2001 | Pertrushin | 704/272 |
| 6,353,810 | B1 * | 3/2002 | Petrushin | 704/236 |
| 6,424,939 | B1 * | 7/2002 | Herre et al. | 704/219 |
| 6,708,145 | B1 * | 3/2004 | Liljeryd et al. | 704/200.1 |
| 6,812,876 | B1 * | 11/2004 | Miller | 341/143 |
| 7,002,913 | B2 * | 2/2006 | Huang et al. | 370/230.1 |
| 7,103,539 | B2 * | 9/2006 | Kleijn | 704/226 |
| 7,283,955 | B2 * | 10/2007 | Liljeryd et al. | 704/219 |
| 7,359,854 | B2 * | 4/2008 | Nilsson et al. | 704/219 |
| 7,562,021 | B2 * | 7/2009 | Mehrotra et al. | 704/500 |
| 7,590,531 | B2 * | 9/2009 | Khalil et al. | 704/228 |

(Continued)

FOREIGN PATENT DOCUMENTS

WO WO 97/38416 10/1997

(Continued)

OTHER PUBLICATIONS

Makhoul et al. "A mixed-source model for speech compression and synthesis" 1978.*

(Continued)

*Primary Examiner* — Vijay Chawan
*Assistant Examiner* — Greg Borsetti
(74) *Attorney, Agent, or Firm* — Hamilton, Brook, Smith & Reynolds, P.C.

(57) ABSTRACT

A system for enhancing a signal regenerated from an encoded audio signal. The system comprises a decoder arranged to receive the encoded audio signal and produce a decoded audio signal, a feature extraction means arranged to receive at least one of the decoded and encoded audio signal and extract at least one feature from at least one of the decoded and encoded audio signal, a mapping means arranged to map the at least one feature to an enhancement signal and operable to generate and output the enhancement signal, whereby the enhancement signal has a frequency band that is within the decoded audio signal frequency band, and a mixing means arranged to receive the decoded audio signal and the enhancement signal and mix the enhancement signal with the decoded audio signal.

56 Claims, 4 Drawing Sheets

U.S. PATENT DOCUMENTS

| | | | | |
|---|---|---|---|---|
| 2001/0028634 | A1 * | 10/2001 | Huang et al. | 370/252 |
| 2003/0074197 | A1 * | 4/2003 | Chen | 704/262 |
| 2003/0233234 | A1 | 12/2003 | Truman et al. | |
| 2004/0181399 | A1 * | 9/2004 | Gao | |
| 2006/0069559 | A1 * | 3/2006 | Ariyoshi et al. | 704/246 |
| 2006/0129389 | A1 * | 6/2006 | Den Brinker et al. | 704/219 |
| 2006/0217975 | A1 * | 9/2006 | Sung et al. | |
| 2006/0277038 | A1 * | 12/2006 | Vos et al. | 704/219 |
| 2007/0106505 | A1 * | 5/2007 | Gerrits et al. | 704/230 |
| 2007/0225971 | A1 * | 9/2007 | Bessette | 704/203 |
| 2007/0276661 | A1 * | 11/2007 | Dimkovic et al. | 704/229 |
| 2008/0027711 | A1 * | 1/2008 | Rajendran et al. | 704/201 |
| 2008/0040122 | A1 * | 2/2008 | Chen et al. | 704/501 |
| 2008/0046248 | A1 * | 2/2008 | Chen et al. | 704/262 |
| 2008/0167866 | A1 * | 7/2008 | Hetherington et al. | 704/228 |
| 2008/0177532 | A1 * | 7/2008 | Greiss et al. | 704/200.1 |
| 2009/0281813 | A1 * | 11/2009 | Gerrits et al. | 704/500 |
| 2010/0241437 | A1 * | 9/2010 | Taleb et al. | 704/500 |

FOREIGN PATENT DOCUMENTS

| | | | |
|---|---|---|---|
| WO | WO 00/25303 | * | 5/2000 |
| WO | WO 00/45379 | * | 8/2000 |
| WO | WO 2005/009019 A2 | * | 1/2005 |

OTHER PUBLICATIONS

Christensen. "Estimation and Modeling Problems in Parametric Audio Coding" 2005.*

Rødbro. "Speech Processing Methods for the Packet Loss Problem" 2004.*

Rabiner et al. "Digital Processing of Speech Signals" 1978. pp. 120-121.*

Murthi et al. "Packet Loss Concealment With Natural Variations Using HMM" 2006.*

Rodbro et al. "Hidden Markov Model-Based Packet Loss Concealment for Voice over IP" 2006.*

Praestholm et al. "Network Resource Allocation for Perceptually Based Unequal Packet Protection in Voice Communication" 2006.*

Ofir et al. "Packet Loss Concealment for Audio Streaming Based on the GAPES Algorithm" 2005.*

Andersen et al. "Internet Low Bit Rate Codec (iLBC)" 2004.*

Lindblom et al. "Packet Loss Concealment Based on Sinusoidal Extrapolation" 2002.*

Nakamura et al. "An Improvement of G.711 PLC Using Sinusoidal model" 2005.*

Jax et al. "Bandwidth Extension of Speech Signals: A Catalyst for the Introduction of Wideband Speech Coding?" 2006.*

Xydeas et al. "Model-Based Packet Loss Concealment for AMR Coders" 2003.*

Rodbro et al. "Compressed Domain Packet Loss Concealment of Sinusoidally Coded Speech" 2003.*

Lindblom et al. "Packet Loss Concealment Based on Sinusoidal Modeling" 2002.*

Praestholm et al. "On packet loss concealment artifacts and their implications for packet labeling in Voice over IP" 2004.*

Lindblom et al. "Error Protection and Packet Loss Concealment Based on a Signal Matched Sinusoidal Vocoder" 2003.*

Lindblom et al. "Model Based Spectrum Prediction" 2000.*

Taori et al. "Hi-Bin: An Alternative Approach to Wideband Speech Coding" 2000.*

Kovesi, B., et al., "A Scalable Speech and Audio Coding Scheme with Continuous Bitrate Flexbility." *Acoustics, Speech, and Signal Processing* (*ICASSP 2004*), 1: 273-276 (2004).*

International Search Report, PCT/IB2007/004491, date of mailing Oct. 22, 2008.*

EPO Summons to Attend Oral Proceedings Pursuant to Rule 115(1) EPC for Application 07872094.3-1224, Dated Dec. 11, 2010.

Xie, M., et al., "ITU-T.7221.1 Annex C: A New Low-Complexity 14 KHZ Audio Coding Standard." (*ICASSP 2006* ), V:173-176 (2006).

Van de Par, et al., "Scalable Noise Coder for Parametric Sound Coding." Presented at the 118$^{th}$ convention of the Audio Engineering Society, Barcelona, Spain (May 2005).

Sporer, T., et al., "MPEG-4 Low Delay General Audio Coding." Proc. SPIE vol. 4522, p. 109-118, Voice over IP (VoIP) Technology, Petros Mouchtaris; Ed. (2001).

* cited by examiner

SPEECH CODING SYSTEM AND METHOD

RELATED APPLICATION

This application claims priority under 35 U.S.C. §119 or 365 to Great Britain, Application No. 0704622.0, filed Mar. 9, 2007. The entire teachings of the above application are incorporated herein by reference.

TECHNICAL FIELD

This invention relates to a speech coding system and method, particularly but not exclusively for use in a voice over internet protocol communication system.

BACKGROUND

In a communication system a communication network is provided, which can link together two communication terminals so that the terminals can send information to each other in a call or other communication event. Information may include speech, text, images or video.

Modern communication systems are based on the transmission of digital signals. Analogue information such as speech is input into an analogue to digital converter at the transmitter of one terminal and converted into a digital signal. The digital signal is then encoded and placed in data packets for transmission over a channel to the receiver of a destination terminal.

The encoding of speech signals is performed by a speech coder. The speech coder compresses the speech for transmission as digital information, and a corresponding decoder at the destination terminal decodes the encoded information to produce a decoded speech signal, whereby the combination of the encoder and decoder results in a decoded speech signal at the destination terminal that (from the perception of the user of the destination terminal) closely resembles the original speech.

Many different types of speech coding are known and optimised for different scenarios and applications. For example, some speech coding techniques are implemented particularly for encoding speech for transmission over low bit-rate channels. Low bit-rate speech coders are useful in many applications, such as voice over internet protocol ("VoIP") systems and mobile/wireless telecommunications.

An example of a low-rate speech coder is a model-based speech coder that produces a sparse signal representation of the original speech. One particular example of such a model-based speech coder is a speech coder that represents the speech signal as a set of sinusoids. A low-rate sinusoidal speech coder can, for example, encode the linear prediction residual of speech frames classified as voiced using only sinusoids. Many other types of low-rate sparse-signal representation speech coders are also known. These types of low-rate coder form a very compact signal representation. However, the sparse representation in the encoded signal does not fully capture the structure of the speech.

A problem with low-rate model-based speech coders, such as the sinusoidal coder, is that the sparse representation tends to result in metallic-sounding artifacts when the signal is transmitted at a low bit-rate. The metallic artifacts can arise due to the incapability of the underlying sparse model to capture the structure of some of the speech sounds given a limited bit-budget.

If the bit-budget (ultimately related to the bandwidth capabilities of the channel) increases, then more information describing the missing parts of the original speech structure can be added to the transmitted information. This additional description alleviates and eventually removes the artifacts, and thus improves the overall quality and naturalness of the decoded speech signal as perceived by the user of the destination terminal. However, this is obviously only possible if the capability to support a higher bit rate exists.

In addition, the decoding system can compress or expand/stretch a speech signal in time, and/or insert or skip whole speech frames in order to compensate for jitter. Jitter is a variation in the packet latency in the received signal. The decoding system can also insert one or more concealment frames into the speech signal, in order to replace one or more frames that have been lost or delayed in the transmission. The stretching of the speech signal and insertion of the concealment frames into the speech signal can, in particular, give rise to metallic artifacts. These problems are, in general, not mitigated by the use of a higher bit rate.

There is therefore a need for a technique to address the aforementioned problems with low-bit rate coders, and coders in general when loss, delay, and/or jitter may occur in the transmission, in order to improve the perceived quality of the signal at the destination.

SUMMARY

According to one aspect of the present invention there is provided a system for enhancing a signal regenerated from an encoded audio signal, comprising: a decoder arranged to receive the encoded audio signal and produce a decoded audio signal; a feature extraction means arranged to receive at least one of the decoded and encoded audio signal and extract at least one feature from at least one of the decoded and encoded audio signal; a mapping means arranged to map said at least one feature to an enhancement signal and operable to generate and output said enhancement signal, whereby the enhancement signal has a frequency band that is within the decoded audio signal frequency band; and a mixing means arranged to receive said decoded audio signal and said enhancement signal and mix said enhancement signal with said decoded audio signal.

In one embodiment, the encoded audio signal is an encoded speech signal and the decoded audio signal is a decoded speech signal.

According to another aspect of the present invention there is provided a method of enhancing a signal regenerated from an encoded audio signal, comprising: receiving the encoded audio signal at a terminal; producing a decoded audio signal; extracting at least one feature from at least one of the decoded and encoded audio signal; mapping said at least one feature to an enhancement signal and generating said enhancement signal, whereby said enhancement signal has a frequency band that is within the decoded audio signal frequency band; and mixing said enhancement signal and said decoded audio signal.

BRIEF DESCRIPTION OF THE DRAWINGS

For a better understanding of the present invention and to show how the same may be put into effect, reference will now be made, by way of example, to the following drawings in which.

DETAILED DESCRIPTION

Figure 1:
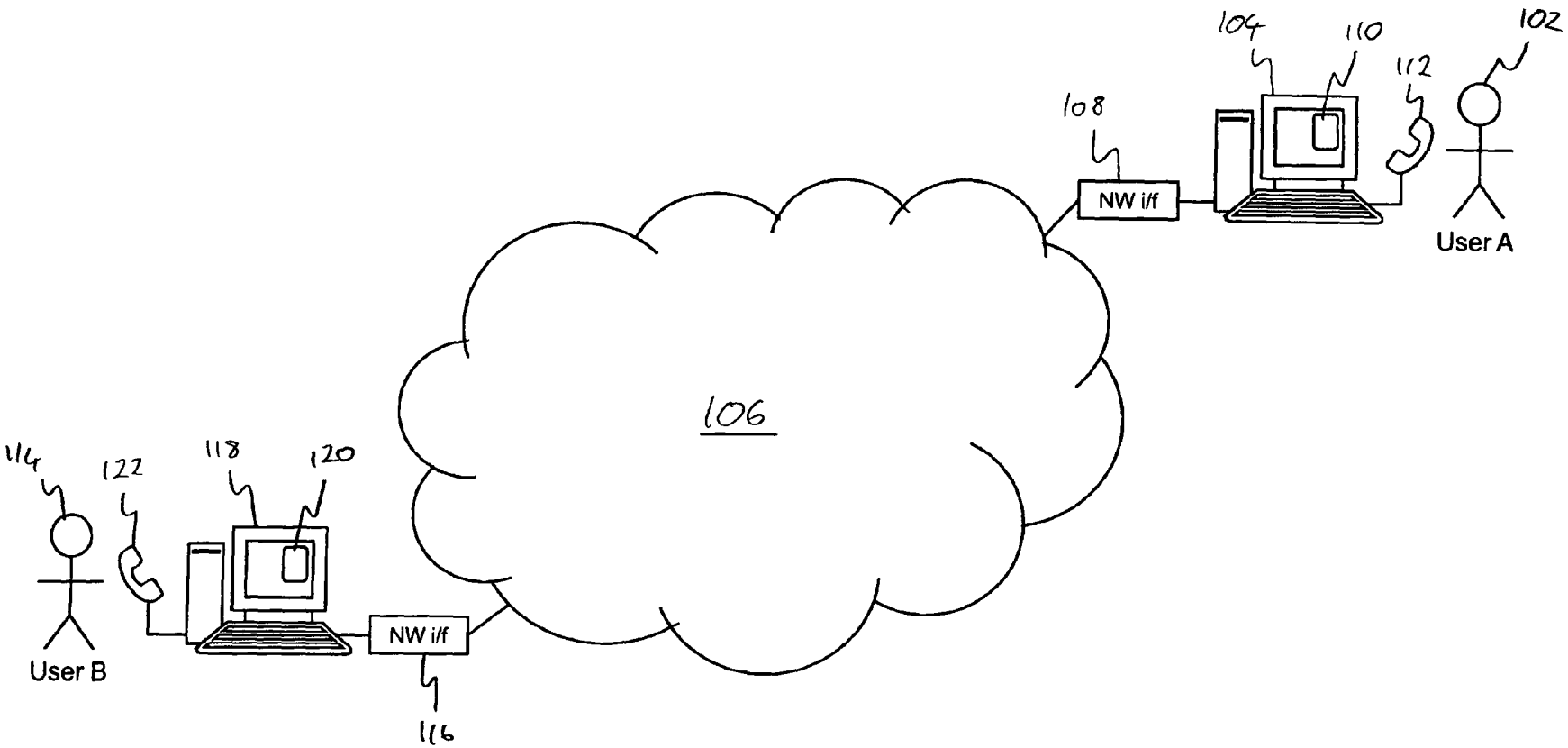
FIG. 1 shows a communication system.

Reference is first made to FIG. 1, which illustrates a communication system 100 used in an embodiment of the present invention. A first user of the communication system (denoted "User A" 102) operates a user terminal 104, which is shown connected to a network 106, such as the Internet. The user terminal 104 may be, for example, a personal computer ("PC"), personal digital assistant ("PDA"), a mobile phone, a gaming device or other embedded device able to connect to the network 106. The user device has a user interface means to receive information from and output information to a user of the device. In a preferred embodiment of the invention the interface means of the user device comprises a display means such as a screen and a keyboard and/or pointing device. The user device 104 is connected to the network 106 via a network interface 108 such as a modem, access point or base station, and the connection between the user terminal 104 and the network interface 108 may be via a cable (wired) connection or a wireless connection.

The user terminal 104 is running a client 110, provided by the operator of the communication system. The client 110 is a software program executed on a local processor in the user terminal 104. The user terminal 104 is also connected to a handset 112, which comprises a speaker and microphone to enable the user to listen and speak in a voice call in the same manner as with traditional fixed-line telephony. The handset 112 does not necessarily have to be in the form of a traditional telephone handset, but can be in the form of a headphone or earphone with an integrated microphone, or as a separate loudspeaker and microphone independently connected to the user terminal 104. The client 110 comprises the speech encoder/decoder used for encoding speech for transmission over the network 106 and decoding speech received from the network 106.

Calls over the network 106 may be initiated between a caller (e.g. User A 102) and a called user (i.e. the destination—in this case User B 114). In some embodiments, the call set-up is performed using proprietary protocols, and the route over the network 106 between the calling user and called user is determined according to a peer-to-peer paradigm without the use of central servers. However, it will be understood that this is only one example, and other means of communication over network 106 are also possible.

Following the establishment of a call between the caller and called user, speech from User A 102 is received by handset 112 and input to user terminal 104. The client 110, comprising the speech coder, encodes the speech, and this is transmitted over the network 106 via the network interface 108. The encoded speech signals are routed to network interface 116 and user terminal 118. Here, client 120 (which may be similar to client 110 in user terminal 104) uses a speech decoder to decode the signals and reproduce the speech, which can subsequently be heard by user 114 using handset 122.

As mentioned, the communication network 106 may be the internet, and communication may take place using VoIP. However, it should be appreciated that even though the exemplifying communications system shown and described in more detail herein uses the terminology of a VoIP network, embodiments of the present invention can be used in any other suitable communication system that facilitates the transfer of data. For example the present invention may be used in mobile communication networks such as TDMA, CDMA, and WCDMA networks.

In one example, for a low bit-rate transmission of speech (e.g. less than 16 kbps) between User A 102 and User B 114 a model-based speech coder such as a harmonic sinusoidal coder can be used. For example, the speech encoder and decoder in clients 110 and 120 in FIG. 1 can be a sinusoidal coder that produces a sparse sinusoidal model that forms a very compact signal representation which is suitable for transmission over a low bit-rate channel. In alternative examples, other types of low-rate sparse-representation speech coder can be used. However, as mentioned previously, for some speech sounds the sparse model is not fully adequate. An example of such a modelling mismatch can be seen illustrated in FIG. 2.

Figure 2:
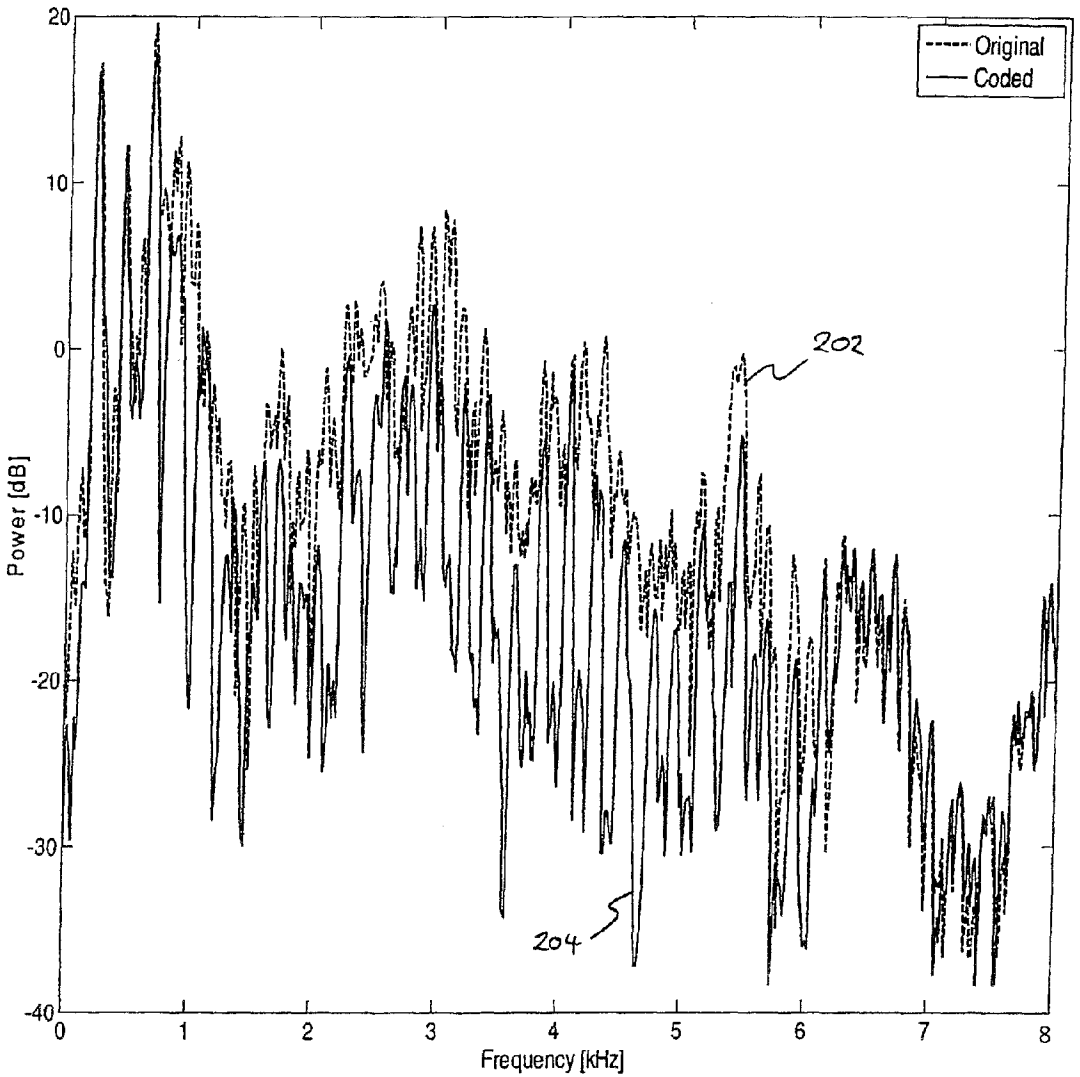
FIG. 2 shows the power spectrum for an example 45 ms speech segment.

FIG. 2 shows the power spectrum for an example 45 ms speech segment. The dashed line 202 shows the original speech power spectrum, and the solid line 204 shows the power spectrum for the speech when coded with a harmonic sinusoidal coder. It can clearly be seen that the power spectrum of the encoded signal deviates significantly from the original power spectrum. A consequence of this model mismatch is that the speech outputted from the decoder contains noticeable metallic artifacts.

Figure 3:
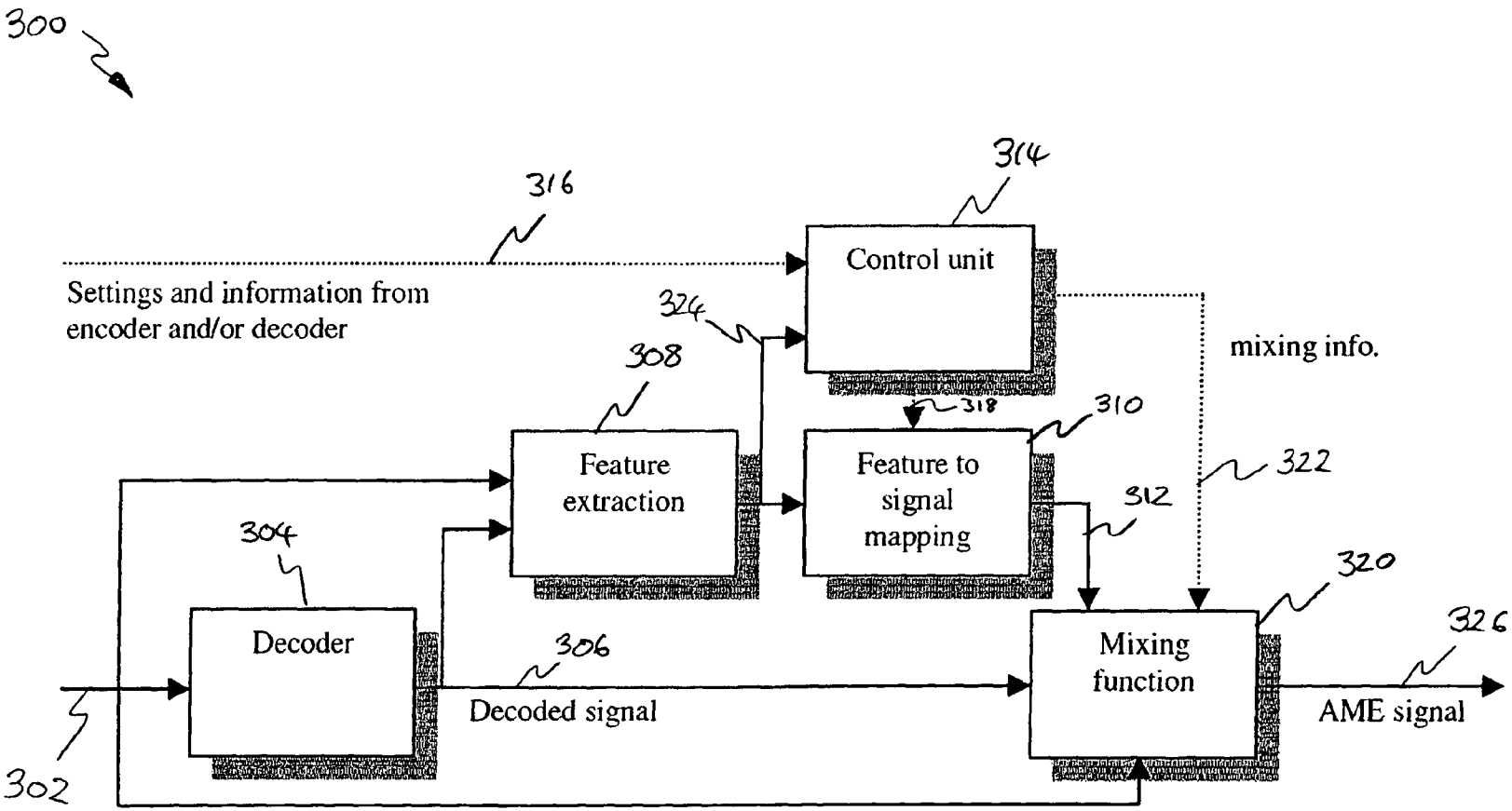
FIG. 3 shows a system for improving the perceived quality of speech signals encoded by a low bit-rate sparse encoder.

Reference is now made to FIG. 3, which illustrates a system 300 for improving the perceived quality of speech signals encoded by a low bit-rate sparse encoder. The system illustrated in FIG. 3 operates at the decoder. Therefore, referring to the example given above for FIG. 1, the system in FIG. 3 is located at the client 120 of the destination user terminal 118.

In general, the system 300 in FIG. 3 utilises a technique whereby an already encoded and/or decoded signal is used to generate an artificial signal, which, when mixed with the decoded signal alleviates or removes the metallic artifacts. This therefore improves the perceived quality. This solution is termed artificial mixed signal ("AMS"). By utilising only the decoded signal at the receiver to generate the artificial signal, zero additional bits need to be transmitted, yet this can be viewed as an additional (virtual) coding layer. In further embodiments, a few additional bits can also be transmitted that describe some information that further improves the generation of the AMS signal.

More specifically, the system 300 in FIG. 3 artificially generates signal components present in the same frequency band as the decoded signal based on information already available at the decoder. For instance, in the example scenario of a low bit-rate sinusoidal encoded signal, the AMS scheme mixes a decoded signal from the sinusoidal decoder with an artificially generated signal that has a more noise-like character. This increases the naturalness of the decoded speech signal.

The input 302 to the system 300 is the encoded speech signal, which has been received over the network 106. For example, this may have been encoded using a low-rate sinusoidal encoder giving a sparse representation of the original speech signal. Other forms of encoding could also be used in alternative embodiments. The encoded signal 302 is input to a decoder 304, which is arranged to decode the encoded signal. For example, if the encoded signal was encoded using a sinusoidal coder, then the decoder 304 is a sinusoidal decoder. The output of the decoder 304 is a decoded signal 306.

Both the encoded signal 302 and the decoded signal 306 are input to a feature extraction block 308. The feature extraction block 308 is arranged to extract certain features from the decoded signal 306 and/or the encoded signal 302. The features that are extracted are ones that can be advantageously used to synthesise the artificial signal. The features that are extracted include, but are not limited to, at least one of: an energy envelope in time and/or frequency of the decoded signal; formant locations; spectral shape; a fundamental frequency or location of each harmonic in a sinusoidal description; amplitudes and phases of these harmonics; parameters describing a noise model (e.g. by filters or time and/or frequency envelope of the expected noise component); and parameters describing the distribution of perceptual importance of the expected noise component in time and/or frequency. The purpose of extracting such features is to provide information about how to generate the artificial signal to be mixed with the decoded signal. One or more of these features may be extracted by the feature extraction block 308.

The extracted features are output from the feature extraction block 308 and provided to a feature to signal mapping block 310. The function of the feature to signal mapping block 310 is to utilise the extracted features and map them onto a signal that complements and enhances the decoded signal 306. The output of the feature to signal mapping block 310 is referred to as an artificially generated signal 312.

Many types of mapping can be used by the feature to signal mapping block 310. For example, types of mapping operation include, but are not limited to, at least one of: a hidden Markov model (HMM); codebook mapping; a neural network; a Gaussian mixture model; or any other suitable trained statistical mapping to construct sophisticated estimators that better mimic the real speech signal.

Furthermore, the mapping operation can, in some embodiments, be guided by settings and information from the encoder and/or the decoder. The settings and information from the encoder and/or the decoder are provided by a control unit 314. The control unit 314 receives settings and information from the encoder and/or decoder, which can include, but are not limited to, the bit rate of the signal, the classification of a frame (i.e. voiced or transient), or which layers of a layered coding scheme are being transmitted. These settings and information are provided to the control unit 314 at input 316, and output from the control unit 314 to the feature to signal mapping block at 318. The information and settings from the encoder and/or decoder can be used to select a type of mapping to be used by the feature to signal mapping block 310. For example, the feature to signal mapping block 310 can implement several different types of mapping operation, each of which is optimised for a different scenario. The information provided by the control unit 314 allows the feature to signal mapping block 310 to determine which mapping operation is most appropriate to use.

In alternative embodiments, the control unit 314 can be integrated into the feature extraction block 308 and the control information provided directly to the feature to signal mapping block 310 along with the feature information.

The artificially generated signal 312 output from the feature to signal mapping block 310 is provided to a mixing function 320. The mixing function 320 mixes the decoded signal 306 with the artificially generated signal 312 to produce an output signal that has a higher perceptual resemblance to the original speech signal.

The mixing function 320 is controlled by the control unit 314. In particular, the control unit uses the coder settings and information from the encoder and/or decoder (from input 316) to provide control information such as, for example, mixing-weights (in time and frequency) to the mixing function 320 in signal 322. The control unit 314 can also utilise information on the extracted features provided by the feature extraction block 308 in signal 324 when determining the control information for the mixing function 320.

In the simplest case the mixing function 320 can implement a weighted sum of the decoded signal 306 and the artificially generated signal 312. However, in advantageous embodiments the mixing function 320 can utilise filter-banks or other filter structures to control the signal mixing in both time and frequency.

In further advantageous embodiments, the mixing function 320 can be adapted using information from the decoded or the encoded signal, in order to exploit known structures of the original signal. For example, in the case of voiced speech signals and sinusoidal coding, a number of the sinusoids are placed at pitch harmonics, and the noise (i.e. the artificially generated signal 312) can in these cases be mixed in with weight-slopes or filters that taper-off from the peak of each of these harmonics towards the spectral valley between such harmonics. The information about each of the sinusoids is contained in the encoded signal 302, which can be provided to the mixing function 320 as an input as shown in FIG. 3.

Furthermore, information from the encoded or decoded signal (302, 306) can be used to avoid the artificially generated signal 312 deteriorating the decoded signal 306 in dimensions along which the decoded signal 306 is already an accurate representation of the original signal. For example, where the decoded signal 306 is obtained as a representation of the original signal on a sparse basis, the artificially generated signal 312 can be mixed primarily in the orthogonal complement to the sparse basis.

In an alternative embodiment, the harmonic filtering and/or the projection to the orthogonal complement can be performed as part of the feature to signal mapping block 310, rather than the mixing function 320.

The output of the mixing function is the artificial mixed signal 326, in which the decoded signal 306 and artificially generated signal 312 have been mixed to produce a signal which has a higher perceived quality than the decoded signal 306. In particular, metallic artifacts are reduced.

The technique described above with reference to FIG. 3, wherein an already encoded and/or decoded signal is used to generate an artificial signal which is mixed with the decoded signal, is similar to techniques used in the field of bandwidth extension ("BWE"). Bandwidth extension is also known as spectral bandwidth replication ("SBR"). In BWE the objective is to recreate wideband speech (e.g. 0-8 kHz bandwidth) from narrowband speech (e.g. 0.3-3.4 kHz bandwidth). However, in BWE an artificial signal is created in an extended higher or lower band. In the case of the technique in FIG. 3, the artificial signal is created and mixed in the same frequency band as the encoded/decoded signal.

In addition, time and frequency shaped noise models have been used both in the context of speech modelling and in the context of parametric audio coding. However, these applications generally utilise a separate encoding and transmission of time and frequency location of this noise. The technique illustrated in FIG. 3, on the other hand, actively exploits the known structure of voiced speech. This enables the above-described technique to generate an artificial noise signal (e.g. extract time and/or frequency envelopes of the noise component) entirely or almost entirely from the encoded and decoded signals, without separate encoding and transmission. It is by this extraction from the encoded and decoded signals that the artificially generated signal can be obtained without any (or very few) extra bits being transmitted. For example, a few extra bits can be transmitted to further enhance the operation of the AMS scheme, such that the extra bits indicate the gain or level of the noise component, provide a rough spectral and/or temporal shape of the noise component, and provide a factor or parameter of the shaping towards the harmonics.

Figure 4:
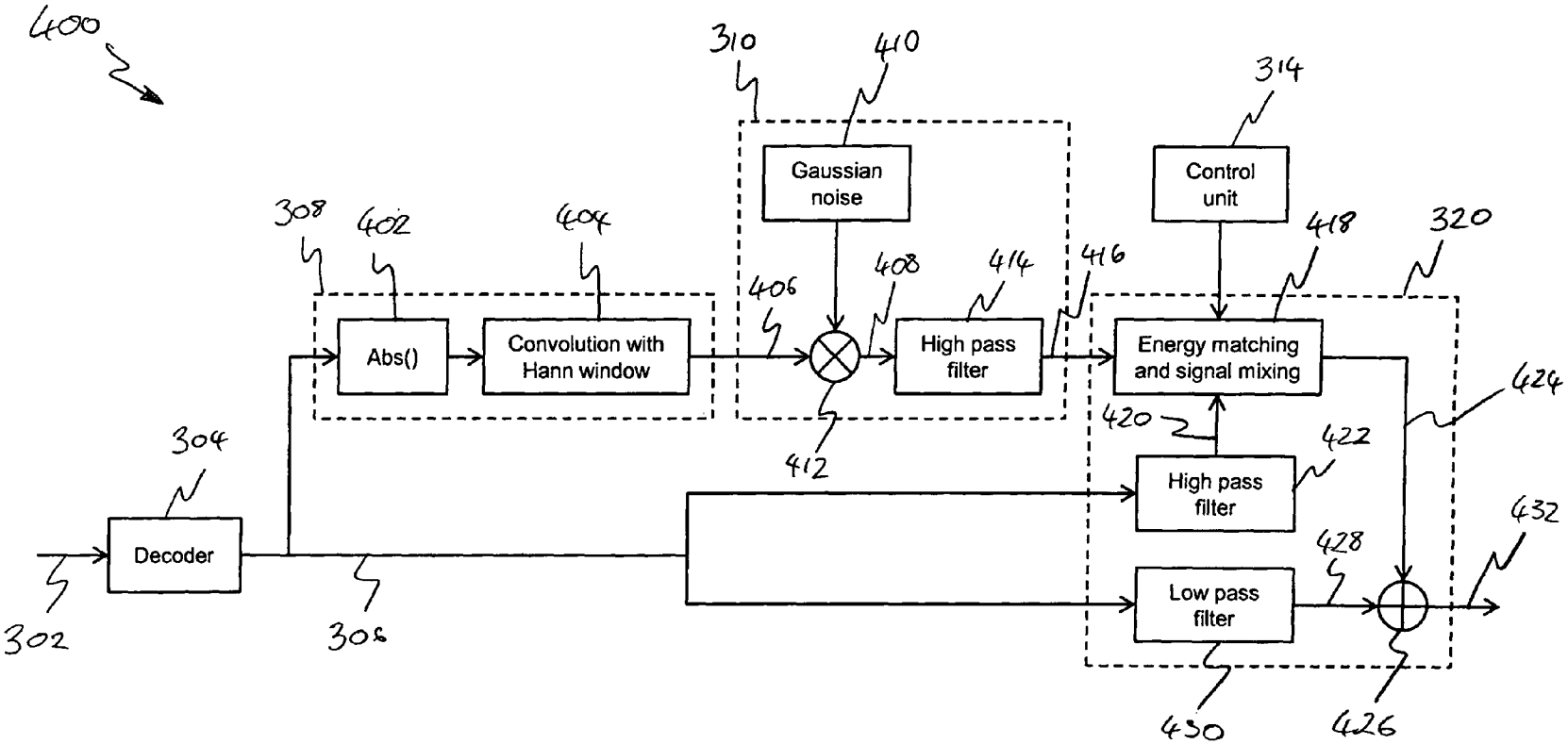
FIG. 4 shows an embodiment of the system in FIG. 3.

As mentioned, FIG. 3 shows a general case of a system for implementing an AMS scheme. Reference is now made to FIG. 4, which illustrates a more detailed embodiment of the general system in FIG. 3. More specifically, in the system 400 illustrated in FIG. 4 the features form a description of the energy envelope over time of the decoded signal, and the artificial signal is generated by modulating Gaussian noise using the features.

The system 400 shown in FIG. 4 operates at the destination terminal of the overall system. For example, referring to FIG. 1, the system 400 is located at the client 120 of the destination user terminal 118. The system 400 receives as input the encoded signal 302 received over the communication network 106. In common with the system in FIG. 3, the encoded signal 302 is decoded using a decoder 304.

The decoded signal 304 is provided to an absolute value function 402, which outputs the absolute value of the decoded signal 304. This is convolved with a Hann window function 404. The result of taking the absolute value and the convolution with the Hann window is a smooth energy-envelope 406 of the decoded signal 306. The combination of the absolute value function 402 and the Hann window 404 perform the function of the feature extraction block 308 of FIG. 3, described hereinbefore, and the smooth energy-envelope 406 is the extracted feature. In a preferred exemplary embodiment, the Hann window has a size of 10 samples.

The smooth energy-envelope 406 of the decoded signal is multiplied with Gaussian random noise to produce a modulated noise signal 408. The Gaussian random noise is produced by a Gaussian noise generator 410, which is connected to a multiplier 412. The multiplier 412 also receives an input from the Hann window 404. The modulated noise signal 408 is then filtered using a high-pass filter 414 to produce a filtered modulated noise signal 416. The combination of the Gaussian noise generator 410, multiplier 412 and high-pass filter 414 perform the function of the feature to signal mapping block 310 described above with reference to FIG. 3. The filtered modulated noise signal 416 is the equivalent of the artificially generated signal 312 of FIG. 3.

The filtered modulated noise signal 416 is provided to an energy matching and signal mixing block 418. The energy matching and signal mixing block 418 also receives as an input a high-pass filtered signal 420, which is produced by high-pass filter 422 filtering the decoded signal 306. Block 418 matches the energy in the filtered modulated noise signal 416 and high-pass filtered signal 420.

The energy matching and signal mixing block 418 also mixes the filtered modulated noise signal 416 and high-pass filtered signal 420 under the control of control unit 314. In particular, weightings applied to the mixer are controlled by the control unit 314 and are dependent on the bit rate. In preferred embodiments, the control unit 314 monitors the bit rate and adapts the mixing weights such that the effect of the filtered modulated noise signal 416 become less as the rate increases. Preferably, the effect of the filtered modulated noise signal 416 is mainly faded out of the mixing (i.e. the overall effect of the AMS system is minimal) as the rate increases.

The output 424 of the energy matching and signal mixing block 418 is provided to an adder 426. The adder also receives as input a low-pass filtered signal 428 which is produced by filtering the decoded signal 306 with a low-pass filter 430. The output signal 432 of the adder 426 is therefore the sum of the low frequency decoded signal 428 and the high frequency mixed artificially generated signal. Signal 432 is the AMS signal, which has a more noise-like character than the decoded speech signal 306, which increases the perceived naturalness and quality of the speech.

Whereas this invention has been described with reference to an example embodiment in which the perceived quality of a decoded signal has been augmented with an artificially generated signal, it will be understood to those skilled in the art that the invention applies equally to concealment signals, such as those resulting when concealing transmission losses or delays. For example, when one or more data frames are lost or delayed in the channel then a concealment signal is created by the decoder by extrapolation or interpolation from neighbouring frames to replace the lost frames. As the concealment signal is prone to metallic artifacts, features can be extracted from the concealment signal and an artificial signal generated and mixed with the concealment signal to mitigate the metallic artifacts.

Furthermore, the invention also applies to signals in which jitter has been detected, and which have subsequently been stretched or had frames inserted to compensate for the jitter. As the stretched signal or inserted frames are prone to metallic artifacts, features can be extracted from the stretched or inserted signal and an artificial signal generated and mixed with the concealment signal to reduce the effects of the metallic artifacts.

Further, while this invention has been particularly shown and described with reference to preferred embodiments, it will be understood to those skilled in the art that various changes in form and detail may be made without departing from the scope of the invention as defined by the appendant claims.

What is claimed is:

1. A system for enhancing a signal regenerated from an encoded speech signal, comprising:

a decoder at a terminal arranged to receive the encoded speech signal and produce a decoded speech signal comprising a voiced speech signal;

feature extraction means arranged to receive at least one of the decoded and encoded speech signal and extract at least one feature from at least one of the decoded and encoded speech signal;

mapping means arranged to map said at least one feature to an artificially generated noise signal and operable to generate and output said noise signal, whereby the noise signal has a frequency band that is within the decoded speech signal frequency band; and mixing means arranged to receive said decoded speech signal and said noise signal and mix said noise signal with the voiced speech signal in the decoded speech signal frequency band;

wherein the mixing means is further arranged to receive a power for a location in the spectrum of the decoded speech signal and mixing said noise signal and the decoded speech signal at the location and according to the received power.

2. A system according to claim 1, wherein the encoded speech signal is encoded with a model-based speech encoder.

3. A system according to claim 2, wherein the decoder is a model-based speech decoder.

4. A system according to claim 3, wherein the model-based speech decoder is a harmonic sinusoidal speech decoder,

5. A system according to claim 2, wherein the model-based speech encoder is a harmonic sinusoidal speech encoder.

6. A system according to claim 1, whereby the noise signal is noise-like compared to the decoded speech signal.

7. A system according to claim 1, wherein the at least one feature extracted by the feature extraction means is an energy envelope of the decoded speech signal.

8. A system according to claim 7, wherein the feature extraction means comprises an absolute value function arranged to determine the absolute value of the decoded speech signal and a convolution function arranged to receive the absolute value of the decoded speech signal and convolve said absolute value to determine the energy envelope of the decoded speech signal.

9. A system according to claim 7, wherein the mapping means comprises a Gaussian noise generator and a multiplier, wherein said multiplier is arranged to multiply a Gaussian noise signal from said Gaussian noise generator and said feature to generate said noise signal.

10. A system according to claim 9, wherein the mapping means further comprises a high pass filter arranged to filter the output of said multiplier.

11. A system according to claim 10, wherein the mixing means comprises an energy matching means arranged to match the energy in the decoded speech signal and the noise signal.

12. A system according to claim 11, wherein the mixing means further comprises a mixer.

13. A system according to claim 1, further comprising a control means, wherein said control means is arranged to receive information about at least one of said decoded and encoded speech signal, use said information to select a type of mapping, and provide said type of mapping to said mapping means.

14. A system according to claim 13, wherein the control means is further arranged to generate mixer control information and provide said mixer control information to said mixing means.

15. A system according to claim 14, wherein said mixer control information comprises mixing weights.

16. A system according to claim 1, wherein the at least one feature extracted from at least one of the decoded and encoded speech signal includes at least one of: formant locations; a spectral shape; a fundamental frequency; a location of each harmonic in a sinusoidal description; a harmonic amplitude and phase; a noise model; and parameters describing the distribution of perceptual importance of the expected noise component in time and/or frequency.

17. A system according to claim 1, wherein the mapping means is arranged to map said at least one feature to an noise signal using at least one of: a hidden Markov model; a codebook mapping; a neural network; and a Gaussian mixture model.

18. A system according to claim 1, wherein said mixing means is further arranged to receive said encoded speech signal, determine a location of at least one harmonic from said encoded speech signal, and adapt the mixing of said noise signal with said decoded speech signal in dependence on said location of at least one harmonic.

19. A system according to claim 1, wherein the encoded speech signal is received at the terminal from a communication network.

20. A system according to claim 19, wherein the communication network is a peer-to-peer communications network.

21. A system according to claim 1, wherein the encoded speech signal is received in voice over internet protocol data packets.

22. A system according to claim 1, wherein the decoder further comprises means for determining that a frame is missing from the encoded speech signal, and means for generating the decoded speech signal from at least one other frame of the encoded speech signal in response thereto.

23. A system according to claim 22, wherein the means for generating comprises means for interpolating the decoded speech signal from the at least one other frame.

24. A system according to claim 22, wherein the means for generating comprises means for extrapolating the decoded speech signal from the at least one other frame.

25. A system according to claim 1, wherein the decoder further comprises means for detecting jitter in packet latency in the encoded speech signal and means for generating the decoded speech signal such that distortion caused by said jitter is reduced.

26. A system according to claim 25, wherein the means for generating further comprises means for stretching the decoded speech signal to compensate for said distortion.

27. A system according to claim 25, wherein the means for generating further comprises means for inserting a frame into the decoded speech signal to compensate for said distortion.

28. A system according to claim 1, wherein the system enhances a perceived quality of the signal regenerated from the encoded speech signal.

29. A system according to claim 1, wherein the noise signal is a shaped noise signal.

30. A method of enhancing a signal regenerated from an encoded speech signal, comprising:

receiving the encoded speech signal at a terminal;

producing a decoded speech signal comprising a voiced speech signal;

extracting at least one feature from at least one of the decoded and encoded speech signal;

mapping said at least one feature to an artificially generated noise signal and generating said noise signal, whereby said noise signal has a frequency band that is within the decoded speech signal frequency band; and mixing said noise signal and the voiced speech signal of said decoded speech signal;

wherein the mixing further comprises receiving a power for a location in the spectrum of the decoded speech signal and mixing said noise signal and the decoded speech signal at the location and according to the received power.

31. A method according to claim 30, wherein the encoded speech signal is encoded with a model-based speech encoder.

32. A method according to claim 31, wherein producing a decoded speech signal comprises decoding the encoded speech signal with a model-based speech decoder.

33. A method according to claim 32, wherein the model-based speech decoder is a harmonic sinusoidal speech decoder,

34. A method according to claim 31, wherein the model-based speech encoder is a harmonic sinusoidal speech encoder.

35. A method according to claim 30, whereby the noise signal is noise-like compared to the decoded speech signal.

36. A method according to claim 30, wherein the at least one feature extracted is an energy envelope of the decoded speech signal.

37. A method according to claim 36, wherein extracting comprises the steps of determining the absolute value of the decoded speech signal and convolving the absolute value of the decoded speech signal to determine the energy envelope of the decoded speech signal.

38. A method according to claim 36, wherein mapping comprises the steps of a generating Gaussian noise signal and multiplying said Gaussian noise signal and said feature to generate said noise signal.

39. A method according to claim 38, wherein mapping further comprises the step of high pass filtering the output of said multiplier.

40. A method according to claim 39, wherein mixing comprises matching the energy in the decoded speech signal and the noise signal.

41. A method according to claim 30 further comprising receiving information about at least one of said decoded and encoded speech signal at a control means, using said information to select a type of mapping, and applying said type of mapping in said step of mapping.

42. A method according to claim 41, further comprising generating mixer control information at said control means, and utilising said mixer control information in said step of mixing.

43. A method according to claim 42, wherein said mixer control information comprises mixing weights.

44. A method according to claim 30, wherein the at least one feature extracted from at least one of the decoded and encoded speech signal includes at least one of: formant locations; a spectral shape; a fundamental frequency; a location of each harmonic in a sinusoidal description; a harmonic amplitude and phase; a noise model; and parameters describing the distribution of perceptual importance of the expected noise component in time and/or frequency.

45. A method according to claim 30, wherein mapping comprises mapping said at least one feature to an noise signal using at least one of: a hidden Markov model; a codebook mapping; a neural network; and a Gaussian mixture model.

46. A method according to claim 30, wherein mixing comprises receiving said encoded speech signal, determining a location of at least one harmonic from said encoded speech signal, and adapting the mixing of said noise signal with said decoded speech signal in dependence on said location of at least one harmonic.

47. A method according to claim 30, wherein the encoded speech signal is received at a terminal from a communication network.

48. A method according to claim 47, wherein the communication network is a peer-to-peer communications network.

49. A method according to claim 30, wherein the encoded signal is received in voice over internet protocol data packets.

50. A method according to claim 30, wherein producing a decoded speech signal further comprises determining that a frame is missing from the encoded speech signal, and generating the decoded speech signal from at least one other frame of the encoded speech signal in response thereto.

51. A method according to claim 50, wherein generating comprises interpolating the decoded speech signal from the at least one other frame.

52. A method according to claim 50, wherein generating comprises extrapolating the decoded speech signal from the at least one other frame.

53. A method according to claim 30, wherein producing a decoded speech signal further comprises detecting jitter in packet latency in the encoded speech signal and generating the decoded speech signal such that distortion caused by said jitter is reduced.

54. A method according to claim 53, wherein generating comprises stretching the decoded speech signal to compensate for said distortion.

55. A method according to claim 53, wherein generating comprises inserting a frame into the decoded speech signal to compensate for said distortion.

56. A method according to claim 30, wherein the method enhances a perceived quality of the signal regenerated from the encoded speech signal.

* * * * *